US005704240A

United States Patent [19]

Jordan

[11] Patent Number: 5,704,240

[45] Date of Patent: Jan. 6, 1998

[54] METHOD AND APPARATUS FOR FORMING THREADS IN METAL CONTAINERS

[75] Inventor: Charles L. Jordan, New Kensington, Pa.

[73] Assignee: Aluminum Company of America, Pittsburgh, Pa.

[21] Appl. No.: 646,462

[22] Filed: May 8, 1996

[51] Int. Cl.[6] ..... B21D 51/38

[52] U.S. Cl. ..... 72/103; 72/106

[58] Field of Search ..... 72/103, 106, 379.4, 72/94, 118; 215/44

[56] References Cited

U.S. PATENT DOCUMENTS

| | | | |
|---|---|---|---|
| 2,010,228 | 8/1935 | Gibbs | 72/103 |
| 2,045,602 | 6/1936 | Huntsman | 72/103 |
| 2,182,401 | 12/1939 | Kreis et al. | 72/106 |
| 3,844,443 | 10/1974 | Cudzik | 220/40 |
| 4,262,815 | 4/1981 | Klein | 220/273 |
| 4,331,014 | 5/1982 | Miller et al. | 72/94 |
| 4,574,975 | 3/1986 | Taylor et al. | 220/306 |
| 4,793,510 | 12/1988 | Arfert et al. | 220/306 |
| 4,911,323 | 3/1990 | Arfert et al. | 220/257 |
| 5,293,765 | 3/1994 | Nussbaum-Pogacnik | 72/42 |

FOREIGN PATENT DOCUMENTS

| | | | |
|---|---|---|---|
| 1-210 136 | 8/1989 | Japan | 72/379.4 |

*Primary Examiner*—Lowell A. Larson
*Attorney, Agent, or Firm*—David W. Brownlee; E. L. Levine

[57] ABSTRACT

A methods for forming threads in the neck portion of a can made of thin gauge, hard temper metal which minimizes stretching of the metal in the neck portion. The method employs a grooved arbor and roller having a single thread lead around less than 360° of the roller's perimeter.

8 Claims, 3 Drawing Sheets

METHOD AND APPARATUS FOR FORMING THREADS IN METAL CONTAINERS

FIELD OF THE INVENTION

This invention relates to methods for manufacturing of metal cans, and in particular to a method for forming a threaded neck portion on a metal can. The threaded portion of the can is adapted to receive a plastic or metal closure to close and seal the can.

BACKGROUND OF THE INVENTION

It is known to form drawn, or drawn and ironed, cans from aluminum and steel for use in packaging of beer, soft drinks, oil, and other liquids and also for use as aerosol containers for a variety of products. Most metal cans for beer and beverages are adapted to be closed with relatively flat lids or ends which are secured on the cans by double seaming or the like. It is also known to provide cans with cone top ends on them as disclosed by U.S. Pat. Nos. 4,262,815; 4,574,975; 4,793,510 and 4,911,323. It is further known to provide an easy opening container with a reduced diameter cylindrical portion on it and angular spaced thread segments on the cylindrical portion as disclosed in U.S. Pat. No. 3,844,443.

U.S. Pat. No. 5,293,765 discloses a method and apparatus for manufacturing threaded aluminum containers by deep drawing, deep drawing and additional stretching, or extrusion, and rolling threads in a necked-in portion on the end of the container. The threads are formed by positioning first and second thread rolling tools adjacent the inside and outside surfaces of the container and rotatably moving the tools against the surfaces.

Threaded aluminum containers have typically been made from relatively thick metal, i.e., at least 0.020–0.030 inch thick. The aluminum has typically been relatively soft, with a yield strength of about 27–29 ksi, to permit the forming of the threads in such neck.

An improved method is desired for forming threads in cans made of hard temper aluminum alloy sheet material having a yield strength of 36–41 ksi and a thickness of about 0.005–0.015 inch. A threaded aluminum can is desired which is capable of holding positive pressure in the can in the range of 40 to 110 psi when closed with a threaded closure.

SUMMARY OF THE INVENTION

This invention provides methods for forming threads on the neck portions of cans from thin gauge, hard temper metal, such as hard temper aluminum alloy or steel. A thread is formed in a cylindrical neck portion of a can by inserting an arbor in the neck portion and pressing a thread roller having a single thread lead on it against the neck portion as the arbor and the roller are rotated against the cylindrical neck portion of the can.

It is an objective of this invention to provide a method for forming threaded metal containers which are lighter weight than the prior art containers.

It is also an objective of this invention to provide improved metal beverage containers which are adapted to be closed by threaded closures.

BRIEF DESCRIPTION OF THE DRAWINGS

The present inventive method and product of this invention are described in exemplified manner herein relative to drawings wherein.

DESCRIPTION OF PREFERRED EMBODIMENTS

As used herein, the words "upwardly", "downwardly", "inwardly", "outwardly", "horizontal", "vertical" and the like are with reference to a can or can body which is disposed in an upright position with its mouth opening upwardly. "Thread" or "threads" are used to mean a groove in the neck of a can body extending around the neck sufficient for a threaded closure to be rotatably secure on the neck over the mouth opening in it. The groove may extend one or more times around the neck to appear as a plurality of threads.

Figure 1:
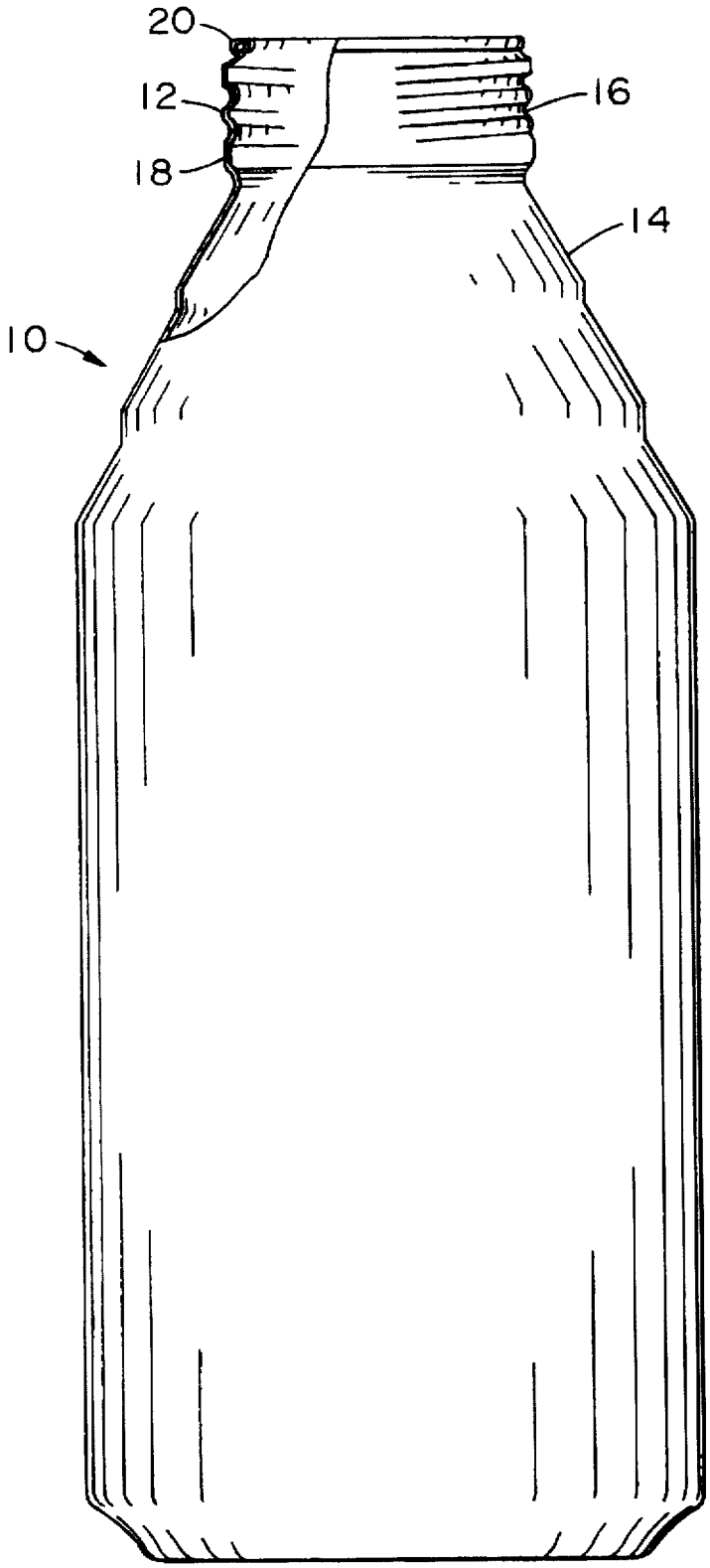
FIG. 1 is a side elevational view of a can in partial cross section showing a neck portion in which threads have been formed in accordance with this invention.

FIG. 1 shows metal can body 10 made of hard temper, thin gauge sheet metal and having threads 12 formed in its top neck portion in accordance with this invention. This can 10 is preferably made entirely of one piece of thin metal such as 3004, 3104 or 3204 H19 aluminum alloys in medium to hard temper. The can body before being necked and threaded is preferably a typical drawn and ironed (D&I) can body except that it has a top "thick wall" portion adapted to be necked into the top portion of the can. A typical drawn and ironed (D&I) can body used with this invention may have metal of about 0.0135 inch in the bottom profile, a thickness of about 0.0055 inch in the thin wall, lower portion of the can which is not necked in, and a thickness about 0.0068 inch in the upper, thick wall portion which is formed into the tapered neck and threads. Such a can body may have a diameter of about 3 inches and a height of about 7⅜ inches to hold 20 fluid ounces or a height of about 8½ inches to hold 30 fluid ounces. Other D&I can bodies for use with this invention may have metal thickness of about 0.010 to 0.015 inch in the bottom profile, a thickness of about 0.0045 to 0.0065 inch in the thin wall portion and a thickness of about 0.0065 to 0.0085 in the thick wall portion. Such cans may have diameters of about 2.5 inches to 3.5 inches and heights of about 5 inches to 10 inches.

The can 10 has a tapered neck portion 14 and a generally cylindrical neck portion 16 in which the threads 12 are formed. It may also have an annular ring portion 18 below the thread 12 and a curled bead 20 around the mouth opening above the threads. The ring portion 18 is adapted to be engaged by a pilfer band on a closure to retain the band on the can upon removal of the closure, and the bead 20 is provided to reinforce the top edge of the container and provide a smooth edge around the mouth opening to enhance drinkability from the opening.

Figure 2:
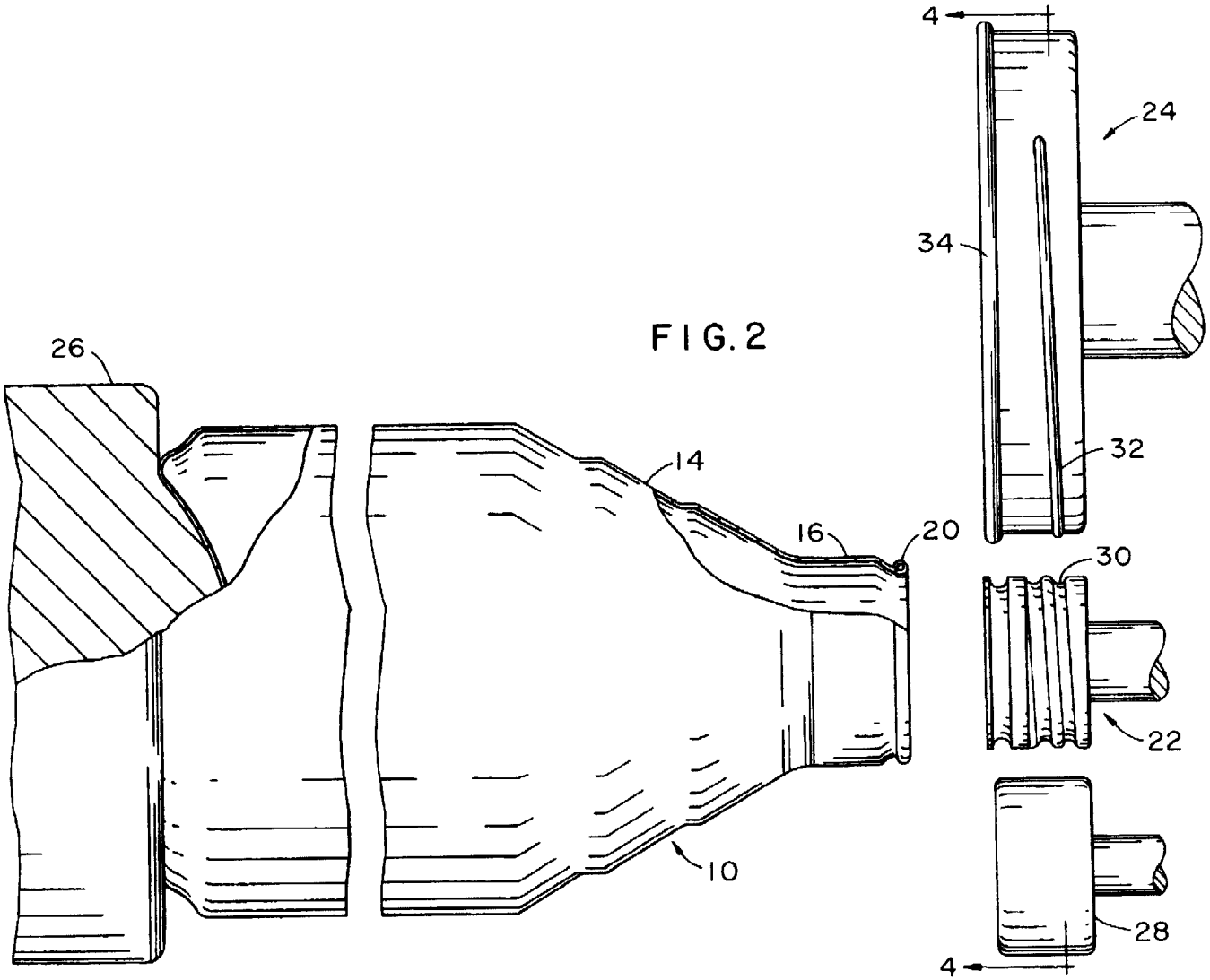
FIG. 2 is a side elevational view of an unthreaded can body in partial cross section of the can body and shows tools for forming threads in the can body in accordance with this invention.

FIG. 2 shows a can 10 before a thread or threads have been formed in its cylindrical neck portion 16 and tools for forming threads in the neck portion. The figure shows a curled bead or folded hem 20 which has been formed around the mouth opening. The bead or hem 20 is preferably formed before the threads have been formed in order to reinforce the cylindrical neck portion and minimize distortion of the neck during forming of the threads. However, for some cans the bead or hem 20 may be formed after the threads are formed.

FIG. 2 shows the can 10 with its longitudinal axis disposed horizontally in preparation for forming a thread or threads in the cylindrical neck portion 16 of the can. Alternatively, the longitudinal axis of the can could be aligned vertically with its mouth opening disposed either up or down. The forming tools include an arbor 22 and a thread roller 24 which are adapted to be moved together against the cylindrical neck portion 16 of can 10 therebetween and rotated about their respective vertical axes to form threads in the cylindrical neck portion 16. The tools further include a rotatable support 26 and at least one cam roller 28, and preferably two cam rollers 28, 29 as best seen in FIG. 4.

The arbor 22 is preferably only slightly smaller in outside diameter than the inside diameter of the cylindrical neck portion 16 of the can so the arbor will fit in the neck portion with a minimum of space between the arbor and the inside of the neck portion. The arbor has a spiral groove 30 in it for cooperation with an outwardly projecting spiral thread lead or rib 32 around its perimeter of the roller 24 for forming a thread on the can 10. The groove 36 preferably spirals around the arbor 22 for more than 360° and preferably about 540° or more in order to form approximately 1½ or more turns of thread around the can mouth. A longer or shorter groove is optional depending on the length of thread desired. In contrast, the thread lead 32 extends less than 360° around the roller 32, and preferably substantially less than 360°.

The roller 24 includes an annular lip 34 around it for forming an annular depression 36 in the cylindrical neck portion 16 which leaves in the locking ring 18 thereabove. The lip 34 may extend entirely around the roller 24 or may extend only part way around the roller. If the lip 34 extends only part way around the roller, then the lip would extend around a first portion of the roller 32 in which there is no thread lead 32 so the lip can form a depression before the thread lead contacts the neck portion 16 to form threads.

Figure 3:
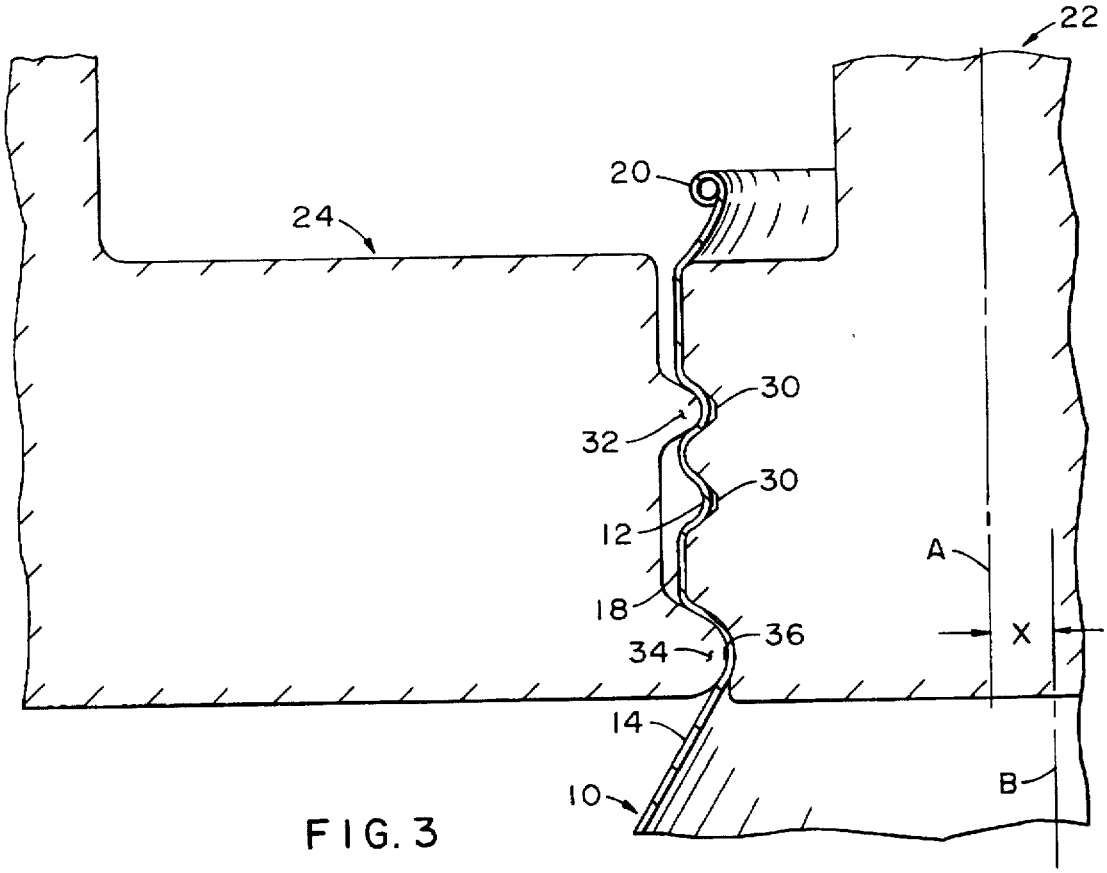
FIG. 3 is an enlarged vertical cross section through the tools of FIG. 2 in the process of forming threads in the cylindrical neck portion of a can body.
Figure 4:
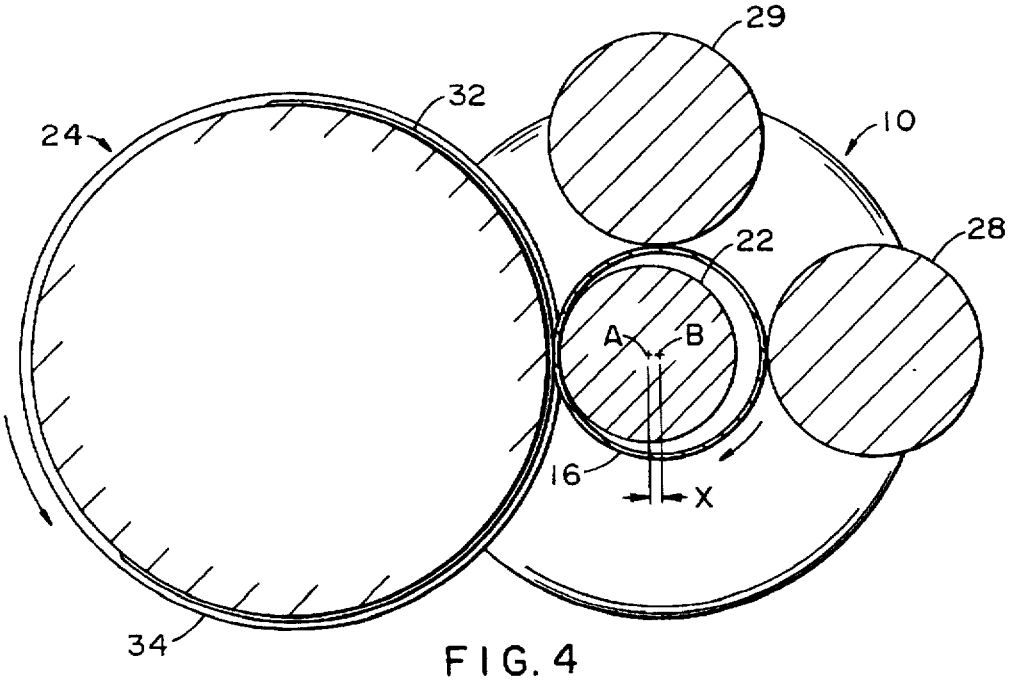
FIG. 4 is a cross section through the tools of FIG. 2 taken along line 4—4 in that Figure and through the thread lead on the roller as it rolls a thread in the neck portion of the can body.

It is important to this invention that the thread lead or rib 32 on roller 24 extends less than 360° around the roller so that the rib will engage the neck portion 16 and the arbor 22 supporting such portion at only one point along the length of the rib 32 at any one time as the arbor and roller are rotated against the neck portion as shown in FIGS. 3 and 4. This means that the metal in the neck portion 16 can be and is drawn into the shape of a thread with little or no stretching of the metal which could tear or fracture the metal. The metal in the cylindrical neck portion 16 of the can body has typically been heavily cold worked during forming of such portion by die necking, spin necking or the like and has a low elongation modulus. Thus, the metal cannot be stretched to form threads using multi-leads on the roller.

As seen in FIG. 3, the top of the neck portion is unrestrained, and the rib 32 and groove 30 engage the neck portion 16 at only one point at a time. The metal in the neck portion 16 is thus permitted to be drawn downwardly as the metal in the neck portion is drawn into the thread 12. This would not be possible if the rib 28 extends more than 360° around the roller 24 so that the ends of the rib overlap one another at some point on the roller which is applied against the neck portion 16. The thread 12 is also preferably formed beginning at the bottom of the neck portion 16, progressively toward the top of the neck portion.

The roller 24 preferably has a circumference great enough to provide a rib 32 thereon which is at least 1½ to 3 or more times the circumference of the neck portion 16 and the arbor 22 in order to form a thread which extends 1½ to 3 or more times around the neck portion. The pitch of the groove 30 in the arbor and the pitch on the rib 32 on the thread roller 24 match one another, and the roller and arbor are geared or otherwise controlled in rotation about their respective axes for the rib to engage the groove at the mating height of both elements on their respective peripheries as they rotate against the neck portion 16.

In the practice of this invention to form a thread in a can neck 16, either the arbor 22 and roller 24 are moved or the can 10 is moved so the arbor is positioned in the can neck with the roller disposed adjacent the outside of the neck. The arbor and/or roller are next moved toward each other to engage the can neck therebetween. The bottom of the can is preferably supported by the rotatable support 26 which permits the can to rotate around its vertical axis and the neck portion 16 is supported by the cam rollers 28 and 29. The location of the cam rollers 28 and 29 is not critical so long as they support the neck portion 16 against excessive wobbling. The axis of rotation "A" of the arbor 22 is offset a distance X from the axis of rotation "B" of the support 26 toward the roller 24 since the arbor has a diameter which is less than the diameter of the neck portion 16 and not centered in such neck portion.

The arbor and roller are rotated about their respective axes to cause the can 10 to be rotated about its axis to form depression 36 and thread 12 around the neck of the can. In the preferred mode of operation, the neck portion 16 is contacted initially by the portion of roller 24 which has a lip 34 but does not have a thread lead 32 on it. The lip 34 is first rotated thereagainst to form the depression 36 around the full perimeter of the neck portion before the thread lead 32 contacts the neck portion 16. This permits the depression to be formed without stretching of metal between the lip 34 and the thread lead 32.

Once the depression 36 has been formed, the roller 24 continues to rotate to press the thread lead 32 against the neck portion 16 and into the groove in the arbor 22 to form a thread 12 in the neck portion. In the preferred mode of operation, the roller is rotated counterclockwise as shown in FIG. 4 so the thread 12 is progressively formed from adjacent the locking ring 18 toward the hem 20 around the top of the neck portion. Alternatively, the roller could be rotated clockwise and the thread progressively formed from the hem 20 toward the locking ring 18.

When the desired length of the thread lead 32 has been rolled against the neck portion 16, the roller 24 is preferably moved away from the neck portion before the thread lead engages the previously formed thread in the neck portion. In other words, the thread lead on roller 24 is rotated against the neck portion 16 for less than 360° of rotation of the roller beginning with one end of the rib 28 in engagement with the neck 16 so the thread is progressively and continuously formed around the neck from one end of the thread to the other. In some cases it may be desirable to form the threads in two operations by first forming a shallow thread and then deepening the thread with a second forming operation using either the same tools or another similar set of tools. After the thread 12 has been formed, the can may or may not be repair coated before or after the threads and/or bead have been formed.

It is seen from the above description and the attached drawings that this invention provides an improved method for forming a thread on a can made of thin gauge, hard temper metal which minimizes stretching of the metal that could cause it to tear or break. It will be apparent to those skilled in the art that numerous variations can be made in the preferred method and tools described above without departing from the invention or the scope of the claims appended hereto. For example, the threads could be formed in a metal cone top which is adapted to be subsequently double seamed or adhesively bonded on the top of a can body.

What is claimed is:

1. A method for forming a thread in a thin gauge, hard temper metal article comprising the steps of:

providing a metal article having a hollow cylindrical portion with an open end and a curled bead or folded hem on said open end;

providing a cylindrical thread-rolling arbor having a diameter smaller than the open end in said hollow cylindrical portion of said article and having a thread shaping groove in the outer surface of said arbor;

providing a thread roller having a single thread lead thereon part way around the roller and an annular lip around the roller below the thread lead;

positioning said arbor in said hollow cylindrical portion of said article with said roller adjacent to the outside of said cylindrical portion; and rotatably driving said arbor and said roller, moving at least one of said arbor and said roller toward the other to press said annular lip against said hollow cylindrical portion and form an annular depression therein and thereafter press said thread lead against said hollow cylindrical portion so said thread lead on the roller deforms the cylindrical portion into the groove in the arbor to form a thread in said hollow cylindrical portion above said annular depression.

2. A method as set forth in claim 1 in which said annular lip continues to contact said annular depression while said thread lead is rolled against the cylindrical portion of said article to form a thread in said hollow cylindrical portion.

3. A method as set forth in claim 1 in which said article is a metal container body and said hollow cylindrical portion is a neck potion on said container body.

4. A method as set forth in claim 3 in which said container body is made of a medium to hard temper aluminum alloy.

5. A method for forming a thread in an aluminum can body comprising the steps of:

providing a can body made of intermediate to hard temper aluminum alloy and having a cylindrical neck portion thereon adapted to have a thread formed therein and an open end on said neck portion with a curled bead or folded hem on said open end;

providing a cylindrical thread-rolling arbor having a diameter smaller than said open end so said arbor will fit in the neck portion of said and body, said arbor having a thread shaping groove in its outer surface;

providing a thread roller having a single thread lead thereon around less than the full perimeter of said roller and an annular lip around said roller below said thread lead;

positioning said can body on said arbor with the arbor inside said neck portion;

rotatably driving said arbor and said roller;

moving said roller against said neck portion on said arbor to form an annular depression in said neck and thereafter roll a thread in said neck above said annular depression; and moving said roller away from said neck.

6. A method as set forth in claim 5 in which the bottom of said can body is rotatably supported.

7. A method as set forth in claim 5 in which said neck portion is supported by at least one cam roller.

8. A method as set forth in claim 5 in which said annular lip extends completely around said thread roller.

* * * * *